US007168422B1

(12) United States Patent
Takata

(10) Patent No.: US 7,168,422 B1
(45) Date of Patent: Jan. 30, 2007

(54) CONTROL APPARATUS FOR AN INTERNAL COMBUSTION ENGINE

(75) Inventor: Tamotsu Takata, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/397,607

(22) Filed: Apr. 5, 2006

(30) Foreign Application Priority Data

Nov. 2, 2005 (JP) ..... 2005-319759

(51) Int. Cl.
*F02D 41/06* (2006.01)

(52) U.S. Cl. ..... 123/674; 123/686; 123/689; 701/109

(58) Field of Classification Search ..... 123/674, 123/685, 686, 689; 701/104
See application file for complete search history.

(56) References Cited

U.S. PATENT DOCUMENTS 6,161,531 A * 12/2000 Hamburg et al. ..... 701/109
6,360,733 B1 * 3/2002 Uberti Bona Blotto et al. ..... 123/689
2004/0035405 A1 * 2/2004 Wagner et al. ..... 123/674

FOREIGN PATENT DOCUMENTS

JP 05-248288 A 9/1993

* cited by examiner

*Primary Examiner*—Erick Solis
(74) *Attorney, Agent, or Firm*—Sughrue Mion, PLLC

(57) ABSTRACT

A control apparatus for an internal combustion engine can avoid overcorrection at a lean side of air fuel ratio learning correction by unburnt fuel in a blowby gas, and prevent rotational speed reduction and engine stall during air fuel ratio open-loop control after restarting of the engine. A temperature detecting section detects the temperature of the engine based on signals of various sensors, and an air fuel ratio learning correction value changing section updates an air fuel ratio learning correction value in accordance with the engine operating condition. When the engine is stopped with its temperature having not yet reached a predetermined value after started from a cold state thereof, an amount of update of the air fuel ratio learning correction value at a lean side is set in such a manner that the lower a temperature parameter immediately before engine starting, the smaller does the amount of update become.

12 Claims, 10 Drawing Sheets

CONTROL APPARATUS FOR AN INTERNAL COMBUSTION ENGINE

BACKGROUND OF THE INVENTION

1. Field of the Invention

The present invention relates to a control apparatus for an internal combustion engine having an air fuel ratio feedback control function and a feedback correction value learning function, and more particularly, it relates to a new technique that can improve air fuel ratio control performance by executing more accurate air fuel ratio learning processing in consideration of the unburnt fuel contained in the blowby gas introduced from an intake pipe in the cold state of an internal combustion engine.

2. Description of the Related Art

In the past, there have been proposed a variety of control apparatuses for an internal combustion engine having an air fuel ratio learning function to detect the generation of a blowby gas containing unburnt fuel in the cold state of the internal combustion engine, and to correct the air fuel ratio of an air fuel mixture based on the detected value of a blowby gas (see, for example, a first patent document (Japanese patent application laid-open No. H5-248288)).

In a conventional apparatus disclosed in the first patent document, a deviation between an average value and a reference value for an air fuel ratio feedback correction value after engine starting is compared with a set value, and when the deviation of the correction value indicates to be larger than the set value, a determination is made that a blowby gas has been generated, so air fuel ratio feedback control for the blowby gas is executed over a predetermined time after such a determination, and normal air fuel ratio feedback control is then executed after the lapse of the predetermined time.

Here, note that in general, the blowby gas is a gas containing an unburnt fuel and a combustion gas that are introduced into an intake pipe through a blowby gas passage after they have blown from a gap between a cylinder and a piston received therein of an internal combustion engine into a crankcase, as well as vaporized components of lubricating oil and vaporized components of fuel mixed in the oil.

As for the unburnt fuel among the components of the blowby gas, the extent or influence or impact thereof on the air fuel ratio correction varies depending upon how much the unburnt fuel is contained in the blowby gas. For example, the lower the temperature of the internal combustion engine, the lower does the volatility of fuel becomes, or the more does the sealing performance between the cylinder and the piston become, so an amount of fuel adhered to the wall surface of the cylinder increases. As a result, the amount of fuel which is contained in the exhaust gas or mixed with the lubricating oil in a combustion chamber defined in the cylinder of the internal combustion engine at the time of explosion stroke increases. Accordingly, the concentration of the fuel in the blowby gas in a warm-up process increases, too. However, since the warm-up state of the internal combustion engine varies or differs according to the environmental condition and the operating condition thereof, it is difficult to specify a blowby gas correction execution period in the conventional apparatus in terms of time.

In addition, even in case where there is no generation of blowby gas, there exist mechanical variations of the internal combustion engine itself or variations of component parts of a fuel injection system. Therefore, regardless of the magnitude of the variations, there necessarily or inevitably exist individual difference or specificity and a deviation of the air fuel ratio in the engine operating range, so it is also difficult to detect the state of generation of a blowby gas by the use of the feedback correction value of the air fuel ratio.

For example, in case where the time for execution of the air fuel ratio feedback for the blowby gas is extremely short in spite of the internal combustion engine being started in the cold state thereof in which the engine temperature is low, an air fuel ratio learning correction value is made lean by introducing the blowby gas containing a large amount of unburnt fuel into the intake pipe. Also, immediately after restarting of the engine after such an operation has been repeated, when the engine is in a low load region where the marginal range of combustion is small, there will be caused a reduction of the rotational speed, an engine stall or the like due to the leaning of the air fuel ratio.

Further, in case where the amount of injection fuel has been increased relative to normal time due to the aging or secular change, failure, etc., of component parts of the internal combustion engine, such a situation will be mis-detected as the state of generation of a blowby gas at a prescribed time at which a blowby gas correction is carried out. Accordingly, in an apparatus that performs fuel correction and air fuel ratio learning correction through normal air fuel ratio feedback as well as self-diagnosis of a fuel supply system by using these corrections, correction processing or failure detection processing can not be executed in a quick manner.

In prior art the control apparatus for an internal combustion engine, it is difficult to specify the period of execution of the correction of blowby gas in terms of time, and a deviation of the air fuel ratio in the operating range of the engine exists due to the variations of various kinds of parts even if no blowby gas has been generated. As a result, there is a problem that the generation of a blowby gas is not able to be detected by an air fuel ratio feedback correction value.

In addition, there is another problem that in case where the air fuel ratio feedback execution time for blowby gas is extremely short irrespective of cold starting, a reduction of the rotational speed, an engine stall or the like will be caused due to the leaning of the air fuel ratio immediately after restarting of the engine after the air fuel ratio learning correction value has been leaned owing to the introduction of a blowby gas.

Further, there is the following problem. That is, in case where the amount of injection fuel has been increased relative to normal time due to the aging or secular change, failure, etc., of component parts of the engine, such a situation will be mis-detected as the generation of a blowby gas at a prescribed time at which a blowby gas correction is carried out, so in the apparatus that performs self-diagnosis of the fuel supply system by using fuel correction and air fuel ratio learning correction through normal air fuel ratio feedback, correction processing or failure detection processing can not be quickly executed.

SUMMARY OF THE INVENTION

The present invention is intended to solve the various problems as referred to above, and has for its object to obtain a control apparatus for an internal combustion engine in which an overcorrection of an air fuel ratio learning correction value in a direction to lean the air fuel ratio of a mixture mainly due to unburnt fuel in a blowby gas after cold starting of the engine is determined based on the start-up or warm-up state of the engine and is reflected on the air fuel ratio learning correction value thereby to prevent excessive leaning of the air fuel ratio that exceeds a combustion limit under a low load of the engine such as after restarting thereof, thus making it possible to avoid the occurrence of reduction of the rotational speed of the engine, an engine stall, etc.

Another object of the present invention is to obtain a control apparatus for an internal combustion engine which is capable of performing quick failure detection while taking account of the influence of a blowby gas containing a large amount of unburnt fuel on the learning of the air fuel ratio even when a fuel supply system has failed.

Bearing the above objects in mind, according to the present invention, there is provided a control apparatus for an internal combustion engine which includes a variety of kinds of sensors that detect an operating condition of the internal combustion engine having a combustion chamber, an intake system and an exhaust system; an injector that injects fuel into the intake system or the combustion chamber of the internal combustion engine; an injector driving section that drives the injector in accordance with the engine operating condition; an air fuel ratio feedback correction value calculation section that calculates an air fuel ratio feedback correction value for the injector driving section; an air fuel ratio learning section that stores an integrated value of the air fuel ratio feedback correction value after updating the integrated value as an air fuel ratio learning correction value; and an air fuel ratio detecting section that detects an air fuel ratio of an exhaust gas in the exhaust system of the internal combustion engine based on detection signals of the various kinds of sensors. The air fuel ratio feedback correction value calculation section calculates a target air fuel ratio based on the engine operating condition, and calculates the air fuel ratio feedback correction value so as to bring the air fuel ratio detected by the air fuel ratio detecting section close to the target air fuel ratio. The air fuel ratio feedback correction value calculation section includes: a temperature detecting section that detects a temperature parameter of the internal combustion engine based on the detection signals of the various kinds of sensors; and an air fuel ratio learning correction value changing section that updates the air fuel ratio learning correction value in accordance with the engine operating condition. When the internal combustion engine is stopped with the temperature parameter having not yet reached a predetermined value after started from a cold state thereof, the air fuel ratio learning correction value changing section sets an amount of update of the air fuel ratio learning correction value at a lean side of the air fuel ratio of the internal combustion engine in such a manner that the lower the temperature parameter immediately before the starting of the internal combustion engine, the smaller does the amount of update become.

According to the present invention, the generation of a blowby gas containing a lot of unburnt fuel that mainly influences the correction of the air fuel ratio is determined based on the operating condition of the internal combustion engine after cold starting thereof, and the learning of the air fuel ratio can be made while excluding the influence of the blowby gas, whereby it is possible to prevent the reduction of the rotational speed and the generation of an engine stall at the time of air fuel ratio open-loop control immediately after the following engine starting.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Hereinafter, preferred embodiments of the present invention will be described in detail while referring to the accompanying drawings.

Embodiment 1

Figure 1:
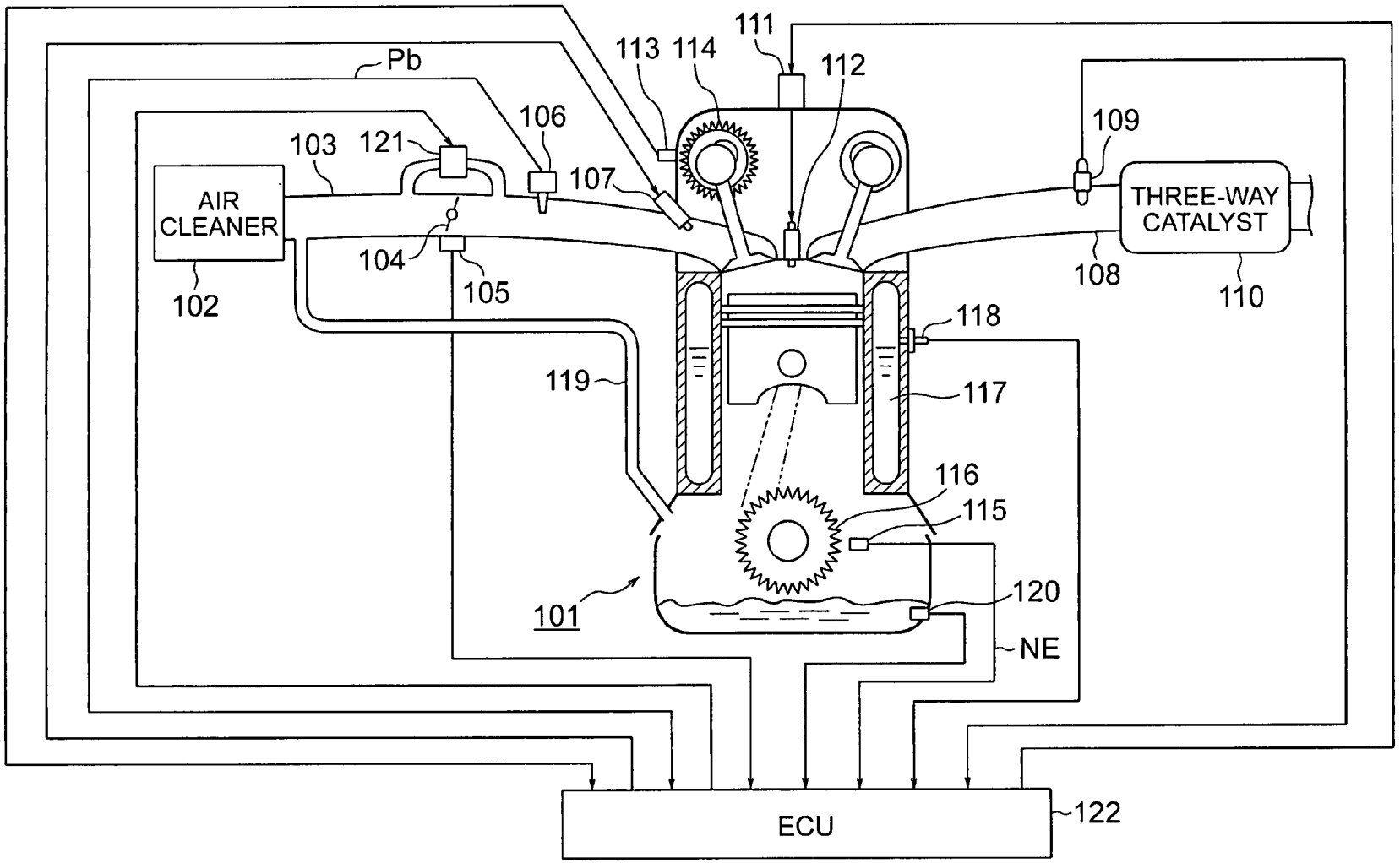
FIG. 1 is a construction view conceptually showing a control apparatus for an internal combustion engine according to a first embodiment of the present invention.

FIG. 1 is a construction view which conceptually shows a control apparatus for an internal combustion engine according to a first embodiment of the present invention.

In FIG. 1, connected with an internal combustion engine 101 are an intake pipe 103, which constitutes an intake system leading to combustion chambers, and an exhaust pipe 108, which constitutes an exhaust system leading from the combustion chambers.

Arranged on the intake pipe 103 are an air cleaner 102 for cleaning air sucked into the internal combustion engine 101, a throttle valve 104 for adjusting an amount of air sucked into the internal combustion engine 101, a throtle opening sensor 105 for detecting the degree of opening of the throttle valve 104, a pressure sensor 106 for measuring the pressure Pb [kPa] (intake manifold pressure) in the intake pipe 103 at a location downstream of the throttle valve 104, and injectors 107 for supplying fuel to the air sucked into the internal combustion engine 101 to form a mixture.

Also, arranged on the exhaust pipe 108 are an oxygen sensor 109 for measuring an amount of residual air (corresponding to an air fuel ratio) in the exhaust gas exhausted from the internal combustion engine 101, and a three-way catalyst 110 for converting harmful components (HC, CO, NOx) of the exhaust gas into harmless gases ($CO_2$ and $H_2O$).

The internal combustion engine 101 includes ignition coils 111 which each generate a high voltage in a secondary coil by supplying and interrupting a current to a primary coil, and spark plugs 112 which each generate a spark under the action of the high voltage generated by a corresponding ignition coil 111. Each spark plug 112 has a tip end inserted into a corresponding combustion chamber of the internal combustion engine 101. Here, note that the injectors 107 may be arranged in the combustion chambers, respectively, of the internal combustion engine 101 so as to inject fuel directly into the combustion chambers.

In addition, the internal combustion engine 101 is provided with a cam angle sensor 113 for generating a cam angle signal, a cam angle sensor plate 114 with a protrusion or recess formed thereon or therein in such a manner that a signal is generated by the cam angle sensor 113, a crank angle sensor 115 for generating a crank angle signal, a crank angle sensor plate 116 with a protrusion or recess formed thereon or therein in such a manner that a signal is generated by the crank angle sensor 115, cooling water 117 for cooling the internal combustion engine 101, a water temperature sensor 118 for detecting the temperature of the cooling water 117, a blowby gas passage 119 for discharging a blowby gas generated in a crankcase to the intake pipe 103, and an oil temperature sensor 120 for measuring the temperature of oil in an oil pan.

The intake pipe 103 is provided with a bypass passage for bypassing the throttle valve 104, with an idle speed control (hereinafter abbreviated as "ISC") valve 121 being mounted on the bypass passage.

The ISC valve 121 serves to maintain the rotational speed of the internal combustion engine 101 at the time of idling at a desired rotational speed by adjusting the amount of air bypassing the throttle valve 104 in an appropriate manner.

An electronic control unit (hereinafter abbreviated as an "ECU") 122 takes in the signals from the various kinds of sensors (the pressure sensor 106, the oxygen sensor 109, the cam angle sensor 113, the crank angle sensor 115, the water temperature sensor 118, etc.) for detecting the operating condition of the internal combustion engine 101, calculates the amount of fuel to be injected from the injectors 107, the ignition timing of each spark plug 112 and so on, and outputs control signals to the various kinds of actuators such as the injectors 107, the ignition coils 111, the ISC valve 121, etc.

Now, reference will be made to a specific control function of the ECU 122 while referring to FIG. 2.

Figure 2:
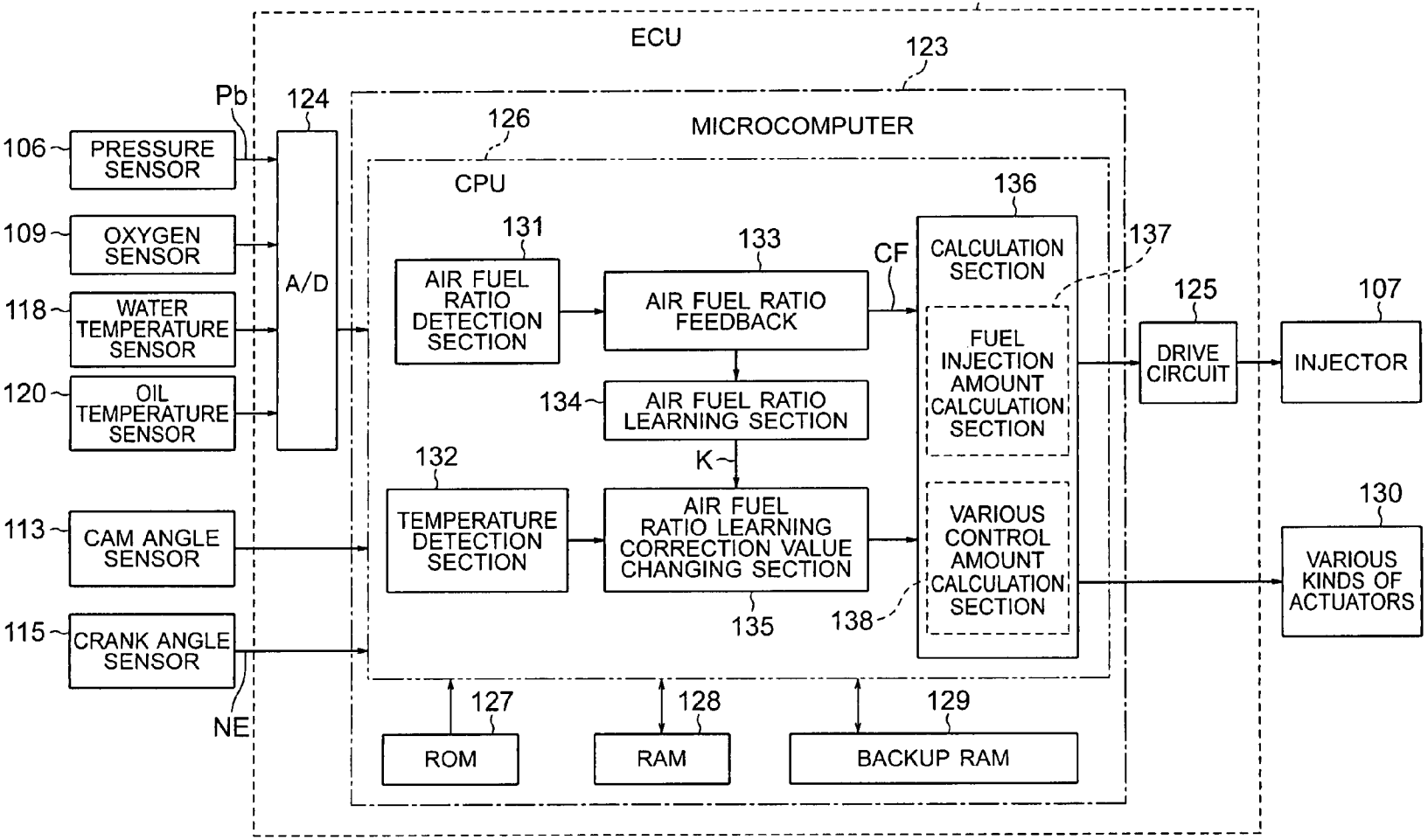
FIG. 2 is a block diagram conceptually showing the functional configuration of the control apparatus for an internal combustion engine according to the first embodiment of the present invention.

FIG. 2 is a block diagram that shows the functional configuration of the ECU 122 together with its hardware configuration and its related peripheral equipment, while mainly illustrating a construction for air fuel ratio control.

The ECU 122 includes a microcomputer 123 that constitutes a various calculation control section, an A/D conversion circuit 124 that converts detection signals from various kinds of sensors from analog into digital form and inputs them to the microcomputer 123, and a drive circuit 125 that drives the injectors 107.

The microcomputer 123 in the ECU 122 comprises a CPU 126 that controls or performs command functions such as a variety of kinds of processing, determinations and so on, a ROM 127, a RAM 128 and a backup RAM 129, all of which belong to the CPU 126.

The ROM 127 is a read-only storage medium, and the RAM 128 is a volatile storage medium that can be freely read and written. The backup RAM 129 is a nonvolatile storage medium which can be freely read and written, and which can preserve the memory or stored contents after the internal combustion engine 101 is stopped.

Digital detection signals from the cam angle sensor 113 and the crank angle sensor 115 are input to an input port of the microcomputer 123, and at the same time, analog signals from the pressure sensor 106, the oxygen sensor 109, the water temperature sensor 118 and the oil temperature sensor 120 are also input to the microcomputer 123 through the A/D conversion circuit 124.

In addition, connected to an output port of the microcomputer 123 are the drive circuit 125 of the injectors 107 and various kinds of actuators 130 such as the ignition coils 111, the spark plugs 112, etc.

The CPU 126 in the microcomputer 123 of the ECU 122 outputs control signals to the various kinds of actuators 130 such as the injectors 107, the ignition coils 111, etc., of the internal combustion engine 101 based on the detection signals from the various kinds of sensors. For example, the drive circuit 125 drives the injectors 107 at timing and for a drive time in response to the operating condition of the internal combustion engine 101, so that a required amount of fuel can be injected by each injector 107 at optimal timing.

The CPU 126 includes an air fuel ratio detecting section 131 that detects the air fuel ratio of an exhaust gas in the exhaust pipe 108 (the exhaust system) based on the detection signal of the oxygen sensor 109, a temperature detecting section 132 that detects a temperature parameter (hereinafter simply abbreviated as a "temperature") based on the detection signal of the water temperature sensor 118 or the oil temperature sensor 120, an air fuel ratio feedback correction value calculation section 133 that calculates an air fuel ratio feedback correction value CF for the drive circuit 125, an air fuel ratio learning section 134 that updates and stores an integrated value of the air fuel ratio feedback correction value CF as the air fuel ratio learning correction value, an air fuel ratio learning correction value changing section 135 that updates the air fuel ratio learning correction value K in accordance with the operating condition of the internal combustion engine 101, and a calculation section 136 that calculates amounts of control for the injectors 107 and the various kinds of actuators 130, respectively.

The air fuel ratio feedback correction value calculation section 133 calculates a target air fuel ratio based on the operating condition of the internal combustion engine 101, also calculates the air fuel ratio feedback correction value CF so as to bring the air fuel ratio detected by the air fuel ratio detecting section 131 close to the target air fuel ratio, and inputs the air fuel ratio feedback correction value CF thus obtained to the calculation section 136.

When the internal combustion engine 101 is stopped with its temperature having not yet reached a predetermined value after started from a cold state thereof, the air fuel ratio learning correction value changing section 135 sets an amount of update of the air fuel ratio learning correction value K at an air fuel ratio lean side of the internal combustion engine 101 in accordance with the temperature of the internal combustion engine 101 immediately before engine starting in such a manner that the lower the temperature of the internal combustion engine 101 immediately before the engine starting, the smaller does the update amount become, and then it inputs the air fuel ratio learning correction value thus updated to the calculation section 136.

The calculation section 136 includes a fuel injection amount calculation section 137 that calculates an amount of control for the drive circuit 125 of the injectors 107, and a various control amount calculation section 138 that calculate amounts of control for the various kinds of actuators 130, respectively, whereby it calculates the various control amounts in accordance with the air fuel ratio feedback correction value CF and the air fuel ratio learning correction value based on the operating condition of the internal combustion engine 101.

Next, schematic reference will be made to the fuel injection amount control operation of the control apparatus for an internal combustion engine according to the first embodiment of the present invention, as shown in FIGS. 1 and 2.

The microcomputer 123 in the ECU 122 controls the amount of fuel to be injected from each injector 107 by executing air fuel ratio feedback control in such a manner that the air fuel ratio of the mixture combusted in the internal combustion engine 101 coincides with the target air fuel ratio suitable for the operating condition of the internal combustion engine 101.

That is, in the above-mentioned air fuel ratio control, the CPU 126 in the microcomputer 123 adds to a basic amount of injection fuel (a basic drive time of each injector 107) obtained based on the intake pipe pressure (intake manifold pressure) Pb detected by the pressure sensor 106, a basic fuel injection amount correction coefficient, which serves to uniformalize the amounts of injection fuel in individual operating regions (which are decided by referring to a map based on the intake pipe pressure Pb and the rotational speed NE of the engine detected by the crank angle sensor 115) to values in the vicinity of a stoichiometric air fuel ratio, various kinds of correction coefficients (an increase correction coefficient during the warm-up operation, etc.), the air fuel ratio feedback correction value CF, and the air fuel ratio learning correction value K learned from an integration correction value Ki in the air fuel ratio feedback correction value CF.

Here, the air fuel ratio feedback correction value CF is represented by the following expression (1).

$$CF=Ki+Kp \tag{1}$$

where Ki is the integration correction value, and Kp is a proportional correction value.

Moreover, the microcomputer 123 executes, at the time of acceleration, a correction calculation by an fuel increase time Ta [msec] for the result of the above-mentioned addition in each engine operating region in accordance with a predetermined state of a vehicle on which the internal combustion engine 101 is installed, and executes a correction calculation by a fuel decrease time Td [msec] at the time of deceleration, whereby it decides a final target fuel injection amount (a target drive time of each injector 107) by taking account of a dead time To [msec] in accordance with a drive voltage of each injector 107.

Here, an injector valve-opening time Ti [msec] corresponding to the target fuel injection amount to be finally supplied is calculated by the following expression (2).

$$Ti=\{Pb\times KPb\times K1\times(CF+K)\}+(Ta-Td)+To \tag{2}$$

where KPb is a conversion coefficient [msec/kPa] for conversion from the intake manifold pressure Pb into the valve-opening time Ti, and K1 is one of the various kinds of correction coefficients (a basic fuel correction coefficient, a warm up increase correction, etc.).

Next, the characteristics of the air fuel ratio feedback correction value CF and the air fuel ratio learning correction value K in the above-mentioned fuel injection control will be described while referring to a timing chart in FIG. 3.

First of all, the air fuel ratio detecting section 131 in the CPU 126 determines, according to whether the detection signal of the oxygen sensor 109 input through the A/D conversion circuit 124 is equal to or less than a reference voltage, whether the air fuel ratio of the internal combustion engine 101 is in a rich state or in a lean state.

Subsequently, the air fuel ratio feedback correction value calculation section 133 increases the air fuel ratio feedback correction coefficient CF if it is determined that the detection result of the air fuel ratio is in a lean state, but decreases the air fuel ratio feedback correction coefficient CF if it is determined that the detection result of the air fuel ratio is in a rich state.

Figure 3:
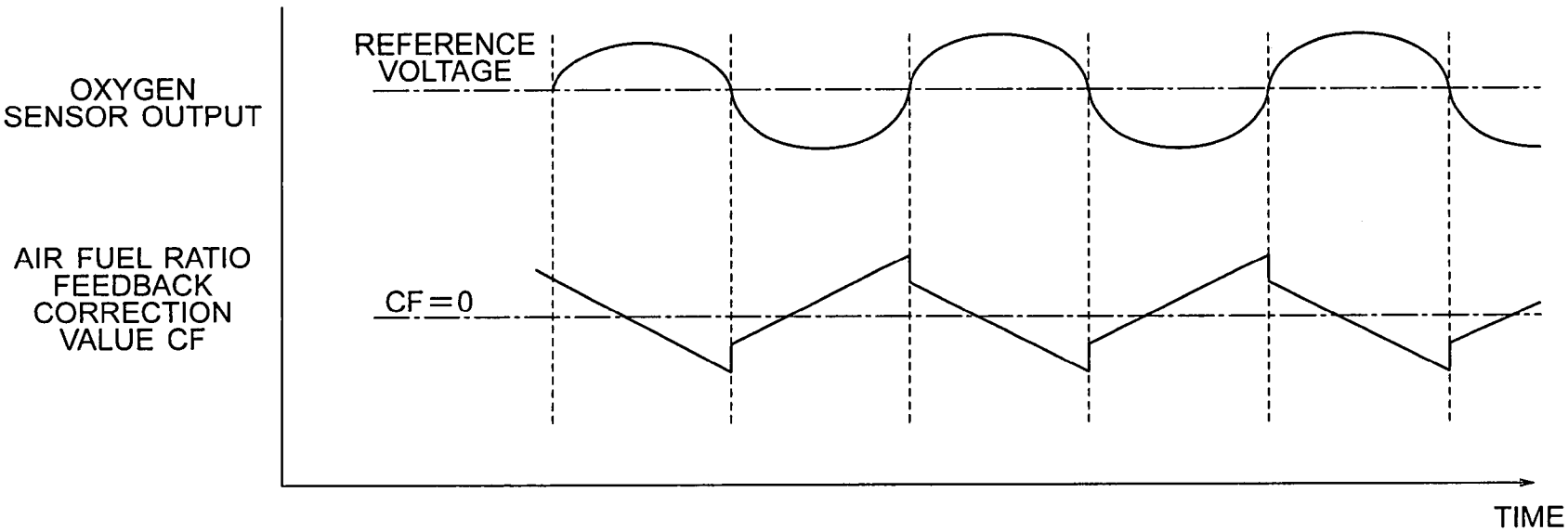
FIG. 3 is a timing chart explaining an operation according to the first embodiment of the present invention.

Hereinafter, the correction processing of the amount of injection fuel is repeated in a periodic manner, as shown in FIG. 3. FIG. 3 shows the individual changes over time of the output signal (voltage value) of the oxygen sensor 109 and the air fuel ratio feedback correction value CF (positive or negative value) with respect to the reference voltage (an alternate long and short dash line) in association with each other.

Next, the learning control of the air fuel ratio according to the first embodiment of the present invention will be described.

The air fuel ratio learning correction value K immediately after battery power has been reset indicates an initial value (=1.0), i.e., a state of no correction, and it is thereafter updated in accordance with a prescribed engine operation with air fuel ratio feedback control, and then stored and held as an updated air fuel ratio learning correction value K.

The update processing at this time is performed in each predetermined period in the following manner by using the integration correction value Ki in the air fuel ratio feedback correction value CF. That is, in the case of rich correction (Ki>0), an update coefficient GR for rich learning correction is added to the air fuel ratio learning correction value, whereas in the case of lean correction (Ki<0), an update coefficient GL for lean learning correction is subtracted from the air fuel ratio learning correction value.

The air fuel ratio learning correction value updated in this manner is reflected on the following air fuel ratio feedback control. As a result, the air fuel ratio feedback correction value CF is corrected to a value in the vicinity of the reference voltage of the oxygen sensor 109.

Specifically, a deviation of the air fuel ratio of the fuel supply system from the stoichiometric air fuel ratio is absorbed by learning from the integration correction value Ki in the air fuel ratio feedback correction value CF, whereby the air fuel ratio feedback correction value CF and the amount of injection fuel at the time of air fuel ratio open loop control are corrected in such a manner that the air fuel ratio is controlled to a value in the vicinity of the stoichiometric air fuel ratio.

In order to achieve the above-mentioned air fuel ratio learning and updating processing, the air fuel ratio detecting section 131 detects the air fuel ratio of the mixture supplied to the internal combustion engine 101. Specifically, the air fuel ratio detecting section 131 takes in the detection signal of the oxygen sensor 109 through the A/D conversion circuit 124.

In addition, the air fuel ratio feedback correction value calculation section 133 makes a comparison between the air fuel ratio detected by the air fuel ratio detecting section 131 and the air fuel ratio target value calculated from the engine operating condition, determines whether the air fuel ratio is in a rich state or in a lean state, and calculates the change correction value so as to bring the detected air fuel ratio close to the target air fuel ratio.

Moreover, the air fuel ratio learning section 134 adds or subtracts, in each predetermined period, the update coefficient GR or GL to or from the air fuel ratio learning correction value K in accordance with the air fuel ratio feedback correction value CF, and stores the result thus obtained.

Further, the air fuel ratio learning correction value changing section 135 takes in the detected temperature from the temperature detecting section 132, and when the internal combustion engine 101 is stopped with its temperature having not yet reached the predetermined value after started from a cold state thereof, the air fuel ratio learning correction value changing section 135 sets the amount of update of the air fuel ratio learning correction value K at the lean side of the air fuel ratio in such a manner that the lower the temperature of the internal combustion engine 101 immediately before engine starting, the smaller does the update amount become.

Figure 4:
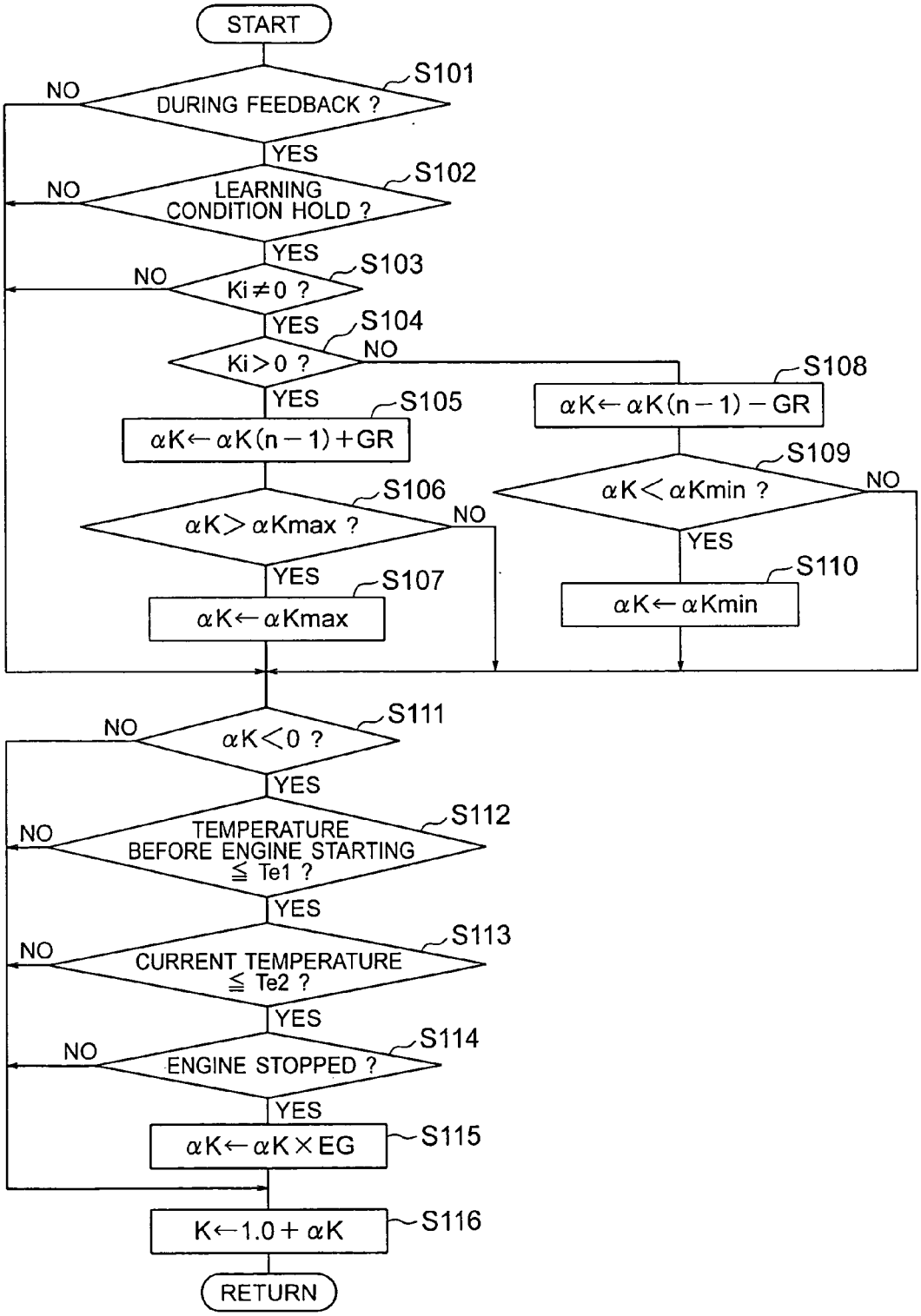
FIG. 4 is a flow chart illustrating a control operation according to the first embodiment of the present invention.

Next, the calculation processing and the learning processing of the air fuel ratio learning correction value K executed by the air fuel ratio learning section 134 and the air fuel ratio learning correction value changing section 135 in the ECU 122 will be specifically described while referring to a flow chart in FIG. 4. The processing of FIG. 4 is executed at each predetermined time (e.g., 25 msec).

In FIG. 4, first of all, it is determined, based on the operating condition of the internal combustion engine 101 (the detection signals of the various kinds of sensors), whether an air fuel ratio feedback control mode (hereinafter simply referred to as an F/B control mode) is under execution (step S101). When it is determined in step S101 that the F/B control mode is not under execution (that is, NO), the control flow proceeds to step S111 to be described later, whereas when it is determined in step S101 that the F/B control mode is under execution (that is, YES), it is subsequently determined whether an air fuel ratio learning condition holds (step S102).

When it is determined in step S102 that the air fuel ratio learning condition does not hold (that is, NO), the control flow proceeds to step S111. In other words, if the result of the determination in step S101 or S102 is "NO", the update processing of the air fuel ratio learning correction value is not carried out.

On the other hand, when it is determined in step S102 that the air fuel ratio learning condition holds (that is, YES), it is subsequently determined whether the integration correction value Ki used for fuel correction calculation at the time of the feedback control mode is under correction (whether Ki≠1 or Ki=0) (step S103).

When it is determined in step S103 as Ki=0 and hence that the integration correction value Ki is not under correction (that is, NO), the control flow immediately proceeds to step S111, so an amount of update αK of the air fuel ratio learning correction value K is not updated, whereas when it is determined in step S103 as Ki≠0 and hence that the integration correction value Ki is under correction (that is, YES), it is subsequently determined whether the integration correction value Ki is under rich correction (whether Ki>0 or Ki<0) (step S104).

When it is determined in step S104 as Ki>0 and hence that the integration correction value Ki is under rich correction (that is, YES), the amount of update αK of the air fuel ratio learning correction value K is updated by using the update coefficient GR for rich learning correction, as shown in the following expression (3) (step S105).

$$\alpha K=\alpha K(n-1)+GR \tag{3}$$

where αK(n−1) is the last value of the amount of update αK.

Subsequently, it is determined whether the amount of update αK of the air fuel ratio learning correction value K is larger than a maximum value αKmax (step S106), and when determined as αK≦αKmax (that is, NO), the control flow immediately advances to the following determination processing (step S111), whereas when determined as αK>αKmax in step S106 (that is, YES), the value of the update amount αK is updated to the maximum value αKmax (step S107), and the control flow proceeds to step S11.

On the other hand, when it is determined in step S104 as Ki<0 and hence that the integration correction value Ki is under lean correction, the amount of update αK of the air fuel ratio learning correction value K is updated by using the update coefficient GL for lean learning correction, as shown in the following expression (4) (step S108).

$$\alpha K=\alpha K(n-1)-GL \tag{4}$$

Subsequently, it is determined whether the amount of update αK of the air fuel ratio learning correction value K is less than a minimum value αKmin (step S109), and when determined as αK≧αKmin (that is, NO), the control flow proceeds to step S11 at once, whereas when determined as αK<αKmin in step S109 (that is, YES), the value of the update amount αK is updated to the minimum value αKmin (step S110), and the control flow proceeds to step S111.

Then, a determination as to whether the air fuel ratio learning correction value K is corrected to a lean side is made based on whether the amount of update αK is a negative value (step S111), and when determined as αK≧0 (that is, NO), the control flow advances to final determination processing (step S116), whereas when determined as αK<0 in step S111 (that is, YES), it is further determined whether the temperature of the internal combustion engine 101 (e.g., the cooling water temperature or the lubricating oil temperature) at the time of an ignition key being turned on before engine starting was equal to or lower than a first predetermined temperature Te1 (step S112). When determined as the engine temperature before engine starting≧Te1 (that is, NO), the control flow proceeds to step S116, whereas when determined as the engine temperature before engine starting≦Te1 in step S101 (that is, YES), it is subsequently determined whether the current temperature of the internal combustion engine 101 is equal to or lower than a second predetermined temperature Te2 (>Te1) (step S113), and when determined the current engine temperature>Te2 (that is, NO), the control flow proceeds to step S116. Here, note that in the same operation after engine starting, once after it is determined as the current engine temperature>Te2, the result of the determination in step S113 becomes "NO" even if determined as the current engine temperature≦Te2 in a later time.

On the other hand, when it is determined in step S113 as the current engine temperature≦Te2 after the starting of the internal combustion engine 101 (that is, YES), it is subsequently determined whether the internal combustion engine 101 is in its stopped state (step S114), and when determined that the internal combustion engine 101 is in operation (that is, NO), the control flow proceeds to step S116, whereas when determined in step S114 that the internal combustion engine 101 is in the stopped state (that is, YES), the amount of update αK of the air fuel ratio learning correction value K is multiplied by an update coefficient EG (0<EG<1) so as to be corrected to decrease (step S115), and the control flow proceeds to step S116.

When either of the results of the determinations in the above steps S111 through S114 is "NO", the decrease correction processing of the update amount αK of the air fuel ratio learning correction value K (step S115) is not executed.

Finally, a value, which is obtained by adding the amount of update αK to an initial value "1.0", is calculated as the air fuel ratio learning correction value K (step S116), and the processing routine of FIG. 4 is terminated.

Figure 5:
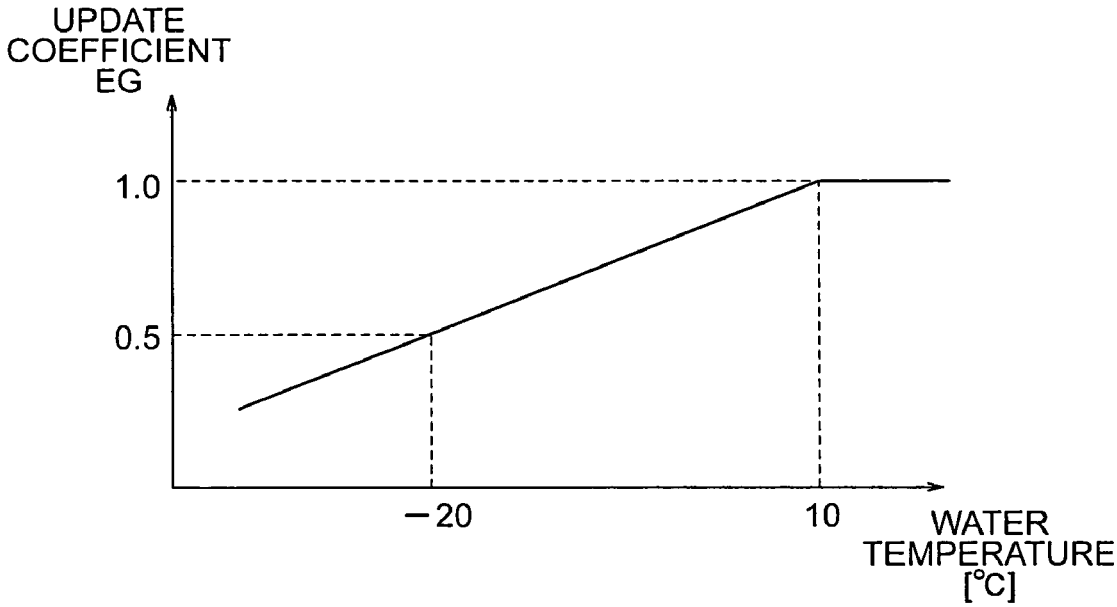
FIG. 5 is an explanatory view showing the operating characteristic of learning correction processing according to the first embodiment of the present invention.

FIG. 5 is an explanatory view that illustrates a variable setting characteristic of the update coefficient EG used in step S115 in FIG. 4.

In FIG. 5, the update coefficient EG for the air fuel ratio learning value K is variably set, for example, with respect to the cooling water temperature [° C.] (e.g., a temperature range in which the cooling water temperature is equal to or lower than 10 [° C.]) detected by the water temperature sensor 118. In this case, the lower the temperature (cooling water temperature) of the internal combustion engine 101 before engine starting (i.e., before the ignition key is turned on), the smaller the update coefficient EG (0<EG<1) is set. In other words, in a variety of kinds of control of the ECU 122, the temperature of the internal combustion engine 101 or the detection signal (water temperature) of the water temperature sensor 118 which is used to specify an engine warm-up state may be mainly used as the temperature parameter of the internal combustion engine 101. Alternatively, for example, the detection signal of the oil temperature sensor 120 installed in the oil pan for measuring the temperature (oil temperature) of the internal combustion engine 101 may be used, and in this case, the temperature of the internal combustion engine 101 can be accurately measured.

Figure 6:
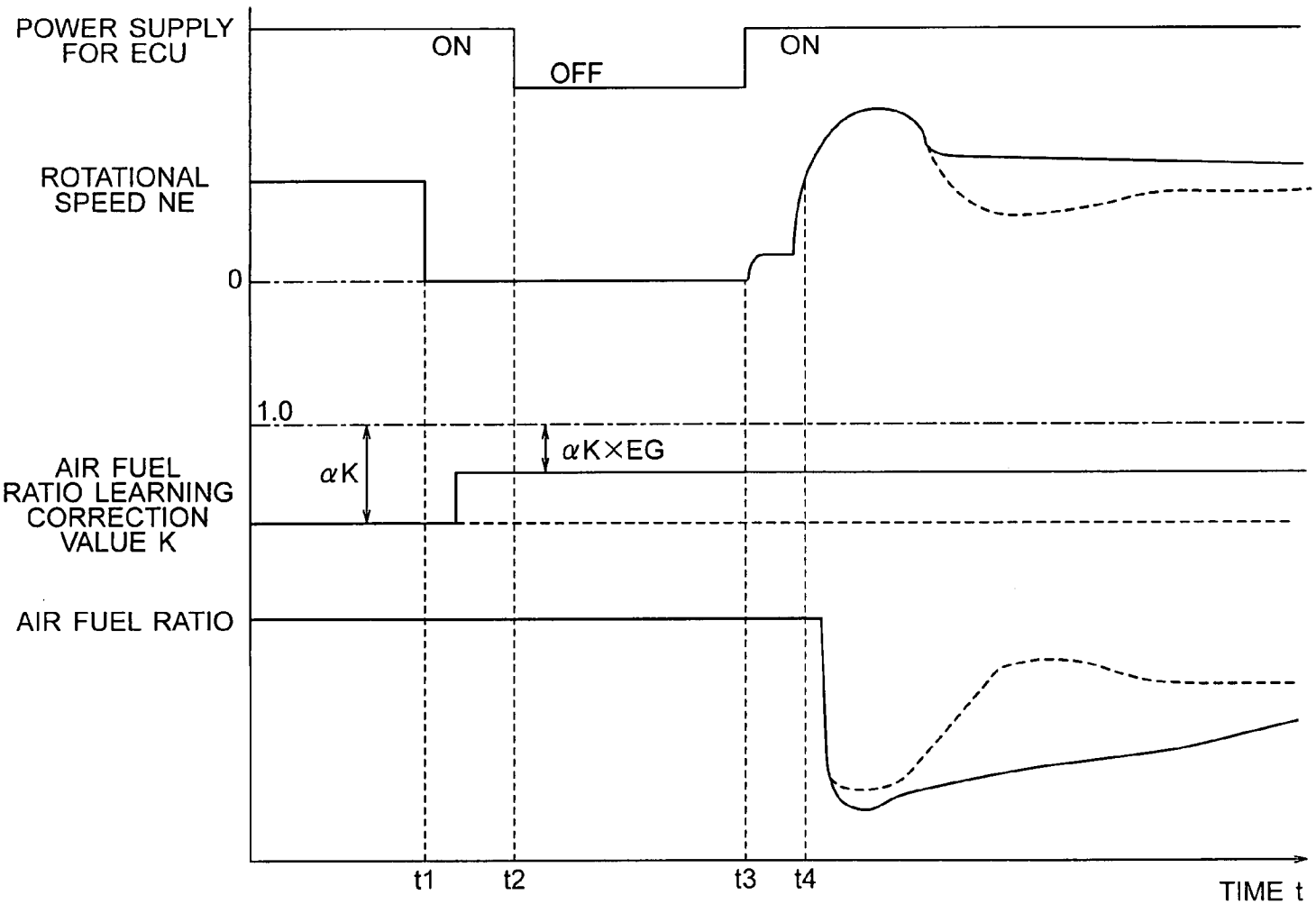
FIG. 6 is a timing chart explaining the operation of the first embodiment of the present invention.

FIG. 6 is a timing chart that explains the operation of the control apparatus for an internal combustion engine according to the first embodiment of the present invention, in which the axis of abscissa represents time t.

In FIG. 6, there are illustrated the individual changes over time of the power supply for the ECU 122 after the restarting of the internal combustion engine 101, the rotational speed NE of the internal combustion engine 101, the air fuel ratio learning correction value K, and the air fuel ratio (detected value) when the change or update condition of the air fuel ratio learning correction value K is met at the time of the last engine operation for example, in comparison with the behaviors (see broken lines) according to the control of the aforementioned conventional apparatus.

First of all, by turning off an ignition key switch (not shown) at time point t1 in FIG. 6, the internal combustion engine 101, which are operating at the rotational speed NE, is stopped, and the power supplied to the ECU 122 is cut off at time point t2 which is delayed a predetermined time from the time point t1. At this time, the above-mentioned step S115 is executed between from the time point t1 to the time point t2, so that the amount of update αK of the lean-side air fuel ratio learning correction value K is reduced by being multiplied by the update coefficient EG corresponding to the temperature of the internal combustion engine 101 immediately before engine starting.

Subsequently, when the ignition key switch is turned on at time point t3, the internal combustion engine 101 begins to be started up, and electric power is started to be supplied to the ECU 122.

As a result, the ECU 122 executes cylinder identification processing based on the individual detection signals of the cam angle sensor 113 and the crank angle sensor 115, and performs, after completing cylinder identification, fuel supply control to the injectors 107 of the respective cylinders and ignition control to the ignition coils 111 of the respective cylinders.

In addition, at time point t4 after the start of operation of the internal combustion engine 101, fuel supply control (driving control of the injectors 107) using the intake manifold pressure Pb detected by the pressure sensor 106 in the intake pipe 103 is started.

From the time point t4 onward, the ECU 122 does not execute air fuel ratio feedback control until the time at which the temperature of the oxygen sensor 109 rises up to or above a sensor operating temperature so that the oxygen sensor 109 outputs a detection signal of a predetermined voltage, but calculates an amount of injection fuel by means of air fuel ratio open-loop control.

In the air fuel ratio open-loop control, when the air fuel ratio learning correction value K is extremely small, the amount of injection fuel decreases, so the actual air fuel ratio (A/F) will indicate a lean air fuel ratio. At this time, particularly in the cold state of the internal combustion engine 101, the combustion limit of the air fuel ratio is lower in comparison with the warm state thereof, so when the combustion limit is exceeded in conventional control (see broken line), the engine rotational speed NE is reduced further greatly, thus causing a fear of engine stall.

However, according to this first embodiment of the present invention, a period from the time point of the last cold starting until the temperature of the internal combustion engine 101 arrives at the second predetermined temperature Te2 (mainly, a period until a lot of unburnt fuel contained in the blowby gas is introduced into the intake pipe 103) is specified based on the operating condition of the internal combustion engine 101, and an air fuel ratio learning correction value K that is likely to cause an overcorrection is reevaluated. As a result, it is possible to avoid the leaning of the air fuel ratio and the generation of rotational speed reduction of the internal combustion engine 101 after the following engine starting.

Thus, by decreasingly correcting the amount of update αK of the air fuel ratio learning correction value K at the lean side in a period until the temperature of the internal combustion engine 101 arrives at the second predetermined temperature Te2 from its temperature immediately before engine starting in such a manner that the lower the temperature of the internal combustion engine 101 immediately before engine starting, the smaller does the update amount αK become (see FIG. 6), it is possible to exclude the influence of overcorrection of the air fuel ratio learning correction value K at the lean side of the air fuel ratio mainly due to the unburnt fuel contained in the blowby gas, and it is also possible to obtain a stable air fuel ratio (A/F) and a stable rotational behavior at the time of low load operation after the following cold starting in which the combustion limit is low.

In particular, as shown in the steps S112 through S116 in FIG. 4, when the internal combustion engine 101 is stopped with its temperature having not yet reached the predetermined value (the second predetermined temperature Te2) after started from the cold state thereof, the stable air fuel ratio (A/F) and the stable rotational behavior can be obtained by setting the amount of update αK of the air fuel ratio learning correction value K at the lean side of the air fuel ratio by using the update coefficient EG corresponding to the temperature of the internal combustion engine 101 immediately before engine starting in such a manner that the lower the temperature of the internal combustion engine 101, the smaller does the amount of update αK become.

Moreover, the temperature detecting section 132 can detect the temperature of cooling water or the temperature of lubricating oil as the temperature parameter of the internal combustion engine 101, or it can instead calculate the temperature of the internal combustion engine 101 from an other unillustrated sensor signal through arithmetic calculations.

Embodiment 2

In the above-mentioned first embodiment, the amount of update αK of the air fuel ratio learning correction value K is corrected by being multiplied by the update coefficient EG (0<EG<1) corresponding to the temperature of the internal combustion engine 101, but the amount of update αK may be corrected by using a second update coefficient GL2 for lean learning correction corresponding to the temperature of the internal combustion engine 101.

Hereinafter, reference will be made to a control apparatus for an internal combustion engine according to a second embodiment of the present invention in which the second update coefficient GL2 for lean learning correction is variably set in accordance with the temperature of the internal combustion engine 101, while referring to FIG. 7 together with FIGS. 1 and 2.

In this case, the ECU 122 includes an update coefficient calculation section that calculates an update coefficient used at the time of the update of the air fuel ratio learning correction value K in accordance with the operating condition of the internal combustion engine 101. The update coefficient calculation section may be included in the function of the air fuel ratio learning section 134 or the air fuel ratio learning correction value changing section 135.

Figure 7:
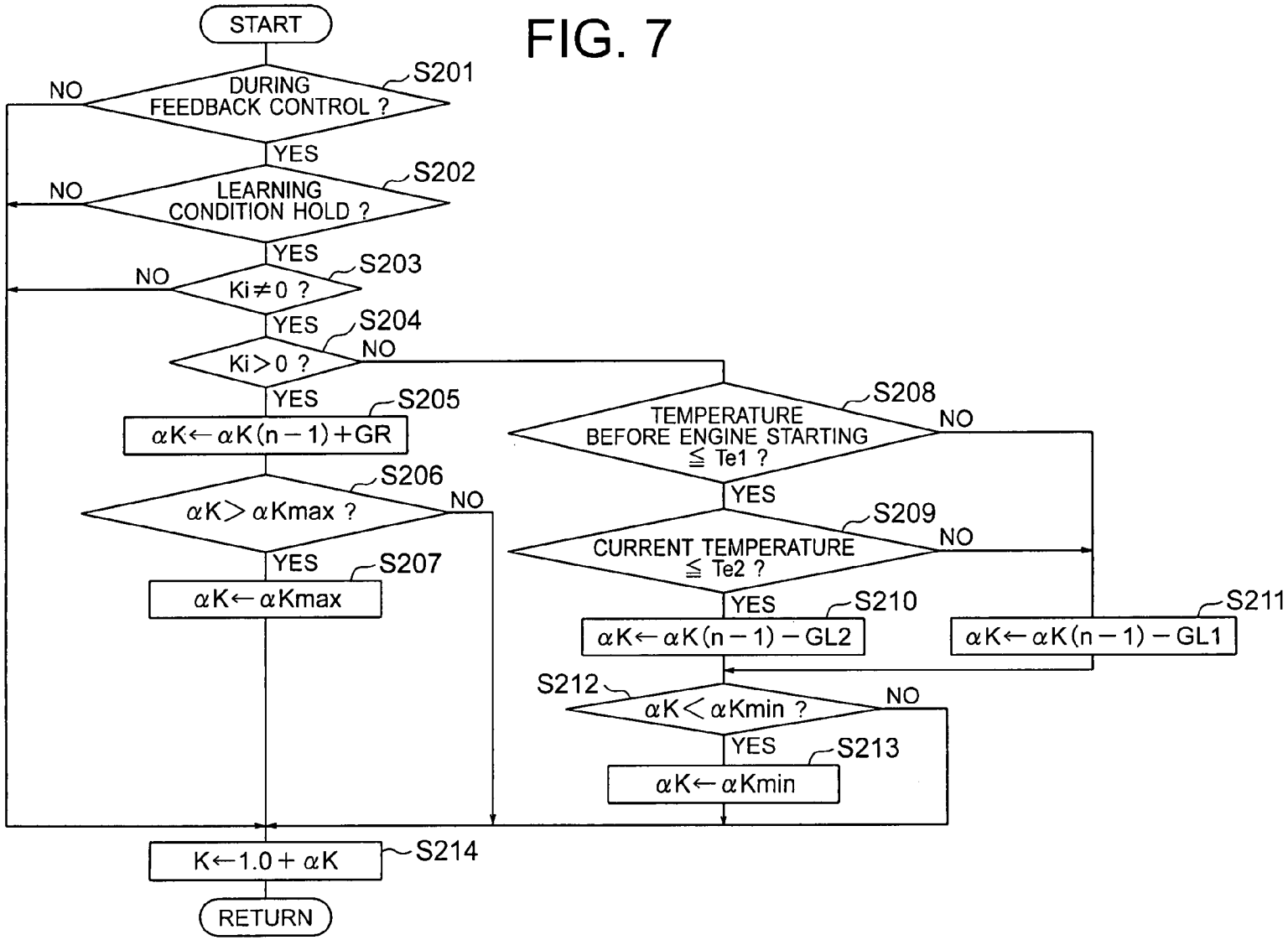
FIG. 7 is a flow chart illustrating a control operation according to a second embodiment of the present invention.

FIG. 7 is a flow chart that illustrates a processing operation according to the second embodiment of the present invention, in which the calculation processing of the air fuel ratio learning correction value K executed by the ECU 122 in FIG. 1 is specifically shown.

In FIG. 7, steps S201 through S207 and steps S212 through S214 are processes similar to those in the above-mentioned steps S101 through S107, S109, S110 and S116 (see FIG. 4). Also, the processing routine of FIG. 7 is executed at each predetermined time (e.g., 25 msec), similarly as stated above.

First of all, it is determined whether an air fuel ratio feedback control mode (F/B control mode) is under execution (step S201), and when determined that the F/B control mode is under execution (that is, YES), it is subsequently determined whether an air fuel ratio learning condition holds (step S202).

When it is determined in step S102 that the air fuel ratio learning condition holds (that is, YES), it is subsequently determined whether the integration correction value Ki used for fuel correction calculation at the time of the F/B control mode is under correction (whether Ki≠0 or Ki=0) (step S203).

When either of the results of the determinations in the above steps S201 through S203 is "NO", the update processing of the update amount αK of the air fuel ratio learning correction value K (step S115) is not executed.

When it is determined in step S203 that the integration correction value Ki is under correction (that is, YES), it is subsequently determined whether the integration correction value Ki is under rich correction (Ki>0) or under lean correction (Ki<0) (step S204).

When it is determined in step S204 that the integration correction value Ki is under rich correction (that is, YES), the amount of update αK of the air fuel ratio learning correction value K is updated through addition by using the update coefficient GR for rich learning correction (step S205), and it is then determined whether the amount of update αK thus updated is larger than the maximum value αKmax (step S206).

When it is determined as αK≦αKmax (that is, NO), the control flow immediately advances to the following determination processing (step S214), whereas when determined as αK>αKmax (that is, YES), the value of the update amount αK is updated to the maximum value αKmax (step S207), and the control flow proceeds to step S214.

The processes of the above-mentioned steps S201 through S207 are similar to those of the above-mentioned steps S101 through S107 (FIG. 4).

On the other hand, when it is determined in step S204 that the integration correction value Ki is under lean correction (that is, NO), it is subsequently determined whether the temperature of the internal combustion engine 101 at the time of the ignition key being turned on before engine starting was equal to or lower than the first predetermined temperature Te1 (step S208).

When it is determined as the engine temperature before engine starting≦Te1 (that is, YES), it is subsequently determined whether the current temperature of the internal combustion engine 101 is equal to or lower than the second predetermined temperature Te2 (step S209).

On the other hand, when it is determined in step S209 as the current engine temperature≦Te2 (that is, YES), the amount of update αK of the air fuel ratio learning correction value K is updated through subtraction by using the second update coefficient GL2 for lean learning correction (step S210), and the control flow advances to the following determination processing (step S212).

Here, note that when the current engine temperature has once arrived at the second predetermined temperature Te2 or above in the same operation after engine starting, the result of the determination in step S209 becomes "NO" even if the engine temperature thereafter falls below the second predetermined temperature Te2.

In addition, the second update coefficient GL2 for lean learning correction is variably set in such a manner that the lower the temperature of the internal combustion engine 101 immediately before engine starting, the smaller does the second update coefficient GL2 become.

On the other hand, when the result of the determination in step S208 or S209 is "NO", the amount of update αK of the air fuel ratio learning correction value K is updated through subtraction by using the first update coefficient GL1 for normal lean learning correction (>GL2) (step S211), and the control flow advances to step S212. The first update coefficient GL1 for lean learning correction may be set to the same value as the above-mentioned update coefficient GL (see FIG. 4).

In step S212, it is determined whether the amount of update αK of the air fuel ratio learning correction value K is less than the minimum value αKmin, and when determined as αK≧αKmin in step S212 (that is, NO), the control flow advances to step S214 at once, whereas when determined as αK<αKmin (that is, YES), the update amount αK is updated to the minimum value αKmin of the air fuel ratio learning correction value update amount (step S213), and the control flow proceeds to step S214.

Finally, in step S214, the air fuel ratio learning correction value K is calculated by adding the amount of update αK to the initial value "1.0", and the processing routine of FIG. 7 is terminated.

Figure 8:
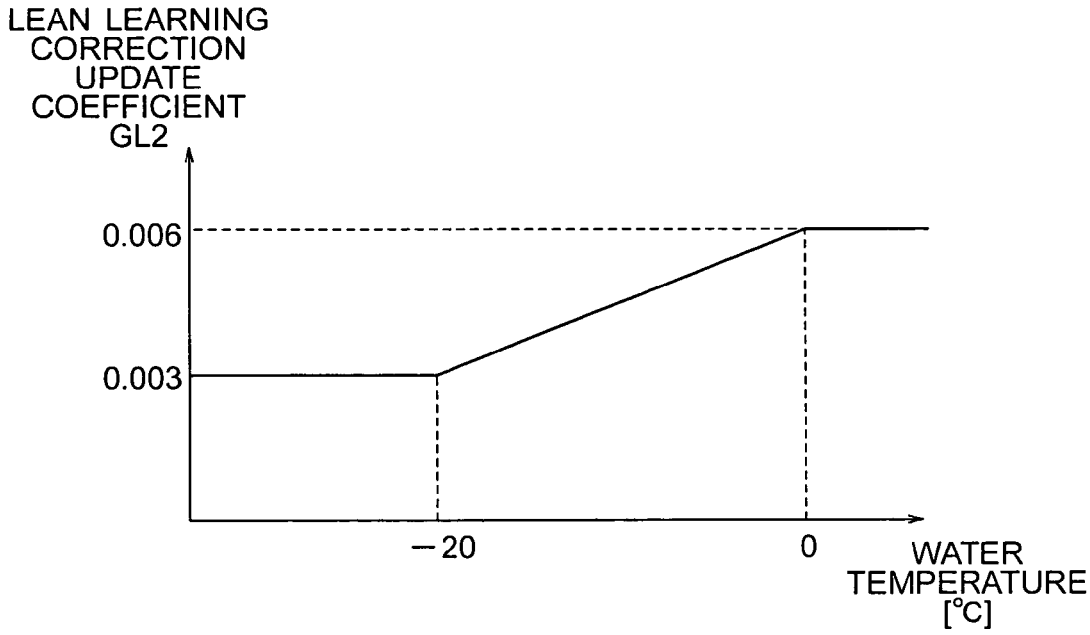
FIG. 8 is an explanatory view illustrating the operating characteristic of learning correction processing according to the second embodiment of the present invention.

FIG. 8 is an explanatory view that illustrates the variable setting characteristic of the second update coefficient GL2 for lean learning correction.

In FIG. 8, the second update coefficient GL2 is variably set, for example, with respect to the cooling water temperature [° C.] (e.g., a temperature range in which the cooling water temperature is equal to or lower than 0 [° C.]) detected by the water temperature sensor 118.

In this case, the update coefficient GL2 is fixedly set to "0.006" when the water temperature is in a range of 0 [° C.] or above, and it is variably set in a positive first-order or linear correlation within a range of "0.003–0.006" when the water temperature is in a range of from −20 [° C.] to 0 [° C.], and it is fixedly set to "0.003" when the water temperature is in a range of −20 [° C.] or below.

As described above, the ECU 122 according to the second embodiment of the present invention includes the update coefficient calculation section that calculates the update coefficient, which is used when the air fuel ratio learning section 134 updates the air fuel ratio learning correction value K, in accordance with the operating condition of the internal combustion engine 101, and when the temperature of the internal combustion engine 101 has not yet reached the predetermined value after the internal combustion engine 101 started from a cold state thereof, the update coefficient calculation section in the ECU 122 calculates the update coefficients GL1 and GL2 of the air fuel ratio learning correction value K at the lean side of the air fuel ratio of the internal combustion engine 101 in such a manner that the lower the temperature of the internal combustion engine 101 immediately before the engine starting, the smaller do the update coefficients GL1 and GL2 become.

That is, when the temperature of the internal combustion engine 101 before engine starting (at the time of the ignition key being turned on) is low, the amount of update αK of the air fuel ratio learning correction value K is variably set by using the second update coefficient GL2 that is smaller than the first update coefficient GL1 and is variably set in accordance with the temperature of the internal combustion engine 101 immediately before engine starting.

Thus, the second update coefficient GL2 of the air fuel ratio learning correction value K at the lean side in a period until the temperature of the internal combustion engine 101 arrives at the second predetermined temperature Te2 from its temperature immediately before engine starting is set in such a manner that the lower the temperature of the internal combustion engine 101 immediately before engine starting, the smaller does the second update coefficient GL2 become. As a result, it is possible to obtain a stable air fuel ratio (A/F) and a stable rotational behavior at the time of low load operation after the following cold starting in which the combustion limit is low, while avoiding the mislearning of the air fuel ratio learning correction value K due to the unburnt fuel contained in the blowby gas.

In addition, herein, the first update coefficient GL1 (>GL2) is set to the fixed value, and the second update coefficient GL2 is variably set in accordance with the temperature of the internal combustion engine 101, but the first and second update coefficients GL1, GL2 (GL1>GL2) may be set to fixed values, respectively, and the update coefficient may be switched into the first update coefficient GL1 or the second update coefficient GL2 in stages in accordance with the temperature of the internal combustion engine 101.

Embodiment 3

Although in the above-mentioned first embodiment, no consideration is given to a cranking time at engine starting as a condition of correcting the amount of update αK of the air fuel ratio learning correction value K, the amount of update αK of the air fuel ratio learning correction value K at the lean side may be set small and stored when the cranking time indicates a reference value or more.

Hereinafter, reference will be made to a control apparatus for an internal combustion engine according to a third embodiment of the present invention in which the amount of update αK of the air fuel ratio learning correction value K is variably set by adding the cranking time as a correction condition, while referring to FIG. 9 together with FIGS. 1 and 2.

In this case, the ECU 122 is provided with a cranking time measurement section that measures the cranking time of the internal combustion engine 101 at engine starting. Also, the air fuel ratio learning correction value changing section 135 in the ECU 122 stores the amount of update αK of the air fuel ratio learning correction value K at the lean side of the air fuel ratio of the internal combustion engine 101 after changing it in accordance with the cranking time.

Specifically, in case where the internal combustion engine 101 is stopped with its temperature having not yet reached the predetermined value after started from a cold state thereof, and where the cranking time indicates a reference time Ct or more, the air fuel ratio learning correction value changing section 135 stores the amount of update αK of the air fuel ratio learning correction value K at the lean side of the air fuel ratio of the internal combustion engine 101 after setting it to a small value.

Here, note that the cranking time measurement section may be included in the function of the air fuel ratio learning section 134 or the air fuel ratio learning correction value changing section 135.

Figure 9:
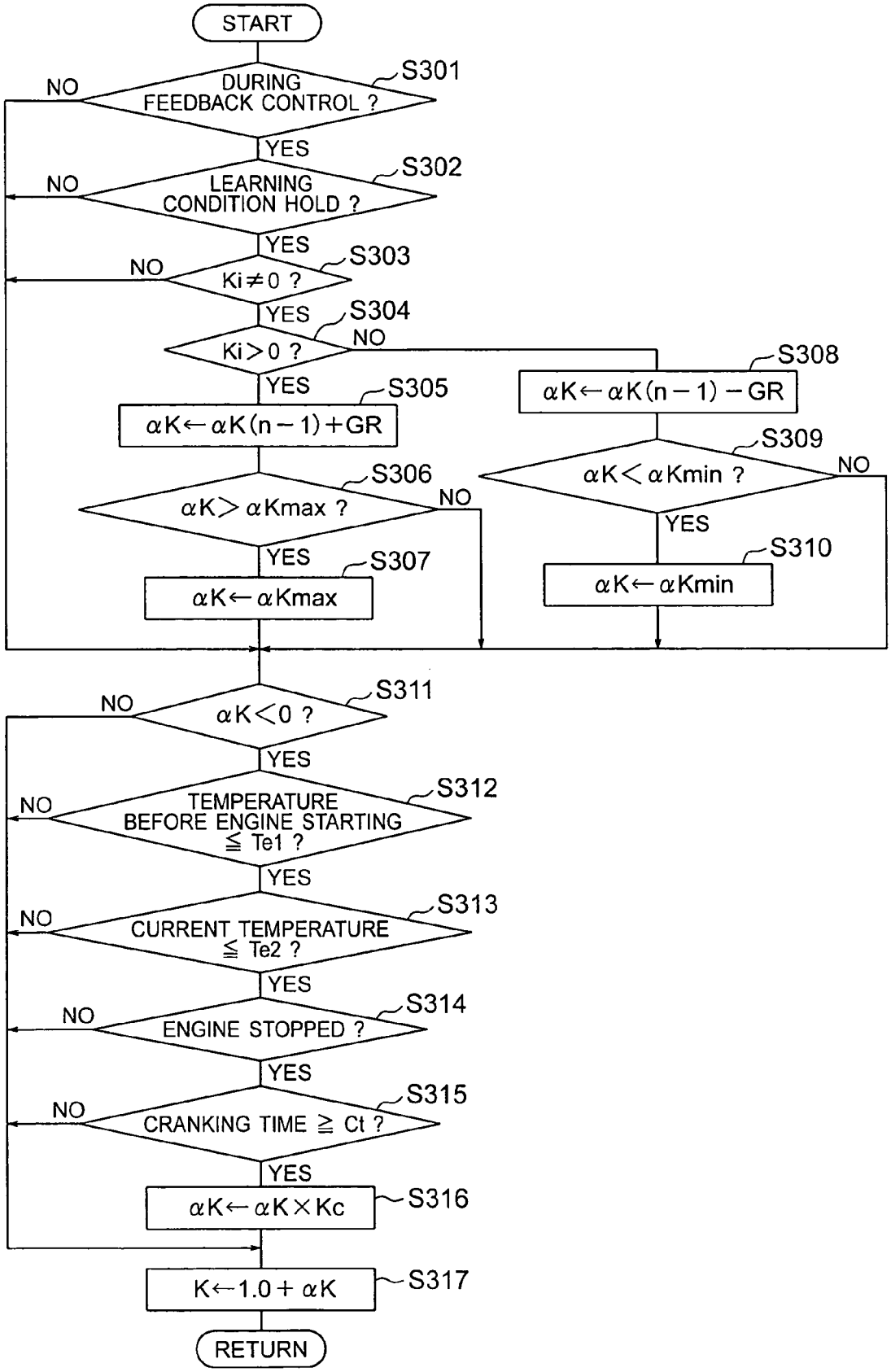
FIG. 9 is a flow chart illustrating a control operation according to a third embodiment of the present invention.

FIG. 9 is a flow chart that illustrates a processing operation according to the third embodiment of the present invention, in which, the calculation processing of the air fuel ratio learning correction value K executed by the ECU 122 in FIG. 1 is specifically shown.

In FIG. 9, steps S301 through S314 and step S217 are processes similar to those in the above-mentioned steps S101 through S114 and S116 (see FIG. 4), and step S316 corresponds to the above-mentioned step S115.

The processing routine of FIG. 9 is different from the above-mentioned one (FIG. 4) in that the determination processing of the cranking time (step S315) is executed subsequent to step S314 and the amount of update αK is corrected by an update coefficient Kc in step S316. Also, the processing routine of FIG. 9 is executed at each predetermined time (e.g., 25 msec), similarly as stated above.

In FIG. 9, first of all, steps S301 through S314 similar to the above-mentioned steps S101 through S114 (FIG. 4) are executed. When it is determined in step S314 that the internal combustion engine 101 is in a stopped state (that is, YES), it is subsequently determined whether the cranking time required to crank the internal combustion engine 101 is equal to or longer than the reference time Ct at engine starting (step S315).

When it is determined as the cranking time≧Ct in step S315 (that is, YES), the amount of update αK of the air fuel ratio learning correction value K is corrected to decrease by using the update coefficient Kc based on the cranking time (step S316), and the control flow advances to the correction processing of the air fuel ratio learning correction value K (step S317).

On the other hand, when it is determined as the cranking time<Ct in step S315 (that is, NO), the control flow proceeds to step S317 at once. That is, when either of the results of the determinations in the above steps S311 through S315 is "NO", the decrease correction processing of the update amount αK of the air fuel ratio learning correction value K (step S316) is not executed.

Finally, in step S317, the air fuel ratio learning correction value K is calculated by adding the amount of update αK to the initial value "1.0", and the processing routine of FIG. 9 is terminated.

The update coefficient Kc used in step S316 is calculated in accordance with a difference between the cranking time of the internal combustion engine 101 and the reference time Ct. That is, an amount of fuel injection or a fuel injection equivalent amount ΔCt per difference between the cranking time and the reference time Ct is first calculated, and a value that is obtained by multiplying the update coefficient Kcb to the fuel injection equivalent amount ΔCt is used as the update coefficient Kc.

Accordingly, the update coefficient Kc is represented as shown in the following expression (5).

$$Kc=1-\Delta Ct\times Kcb \quad (5)$$

Also, it is desirable that the reference time Ct at engine starting be variably set for each temperature of the internal combustion engine 101 immediately before engine starting. In general, the internal combustion engine 101 has a tendency that the lower the temperature of the internal combustion engine 101, the frictions of mainly mechanical parts and lubrication oil increase, thereby making the starting time longer. Accordingly, it is possible to achieve an air fuel ratio learning correction with a further high degree of precision by variably setting the reference time Ct so as to make it correspond to the cranking time that changes in accordance with the temperature of the internal combustion engine 101.

As described above, according to the third embodiment of the present invention, when the cranking time at the starting of the internal combustion engine 101 was required or taken more than necessary, by decreasingly correcting the amount of update αK of the lean-side air fuel ratio learning correction value K to a smaller value in consideration of the unburnt fuel mixed in the lubricating oil, it is possible to obtain a stable air fuel ratio (A/F) and a stable rotational behavior at the time of low load operation after the following cold starting in which the combustion limit is low.

Embodiment 4

Although in the above-mentioned first embodiment, the results of comparisons between the engine temperature before engine starting and the current engine temperature, and between the engine temperature before engine starting and the first and second predetermined temperatures Te1, Te2 are used as conditions for correcting the amount of update αK of the air fuel ratio learning correction value K (see the steps S112, S113 in FIG. 4), the result of a comparison between an idle rotational speed learning correction value and a predetermined value LR may instead be used.

Hereinafter, reference will be made to a control apparatus for an internal combustion engine according to a fourth embodiment of the present invention in which the amount of update αK of the air fuel ratio learning correction value K is variably set by adding the idle rotational speed learning correction value (hereinafter referred to as an "ISC learning value") as a correction condition, while referring to FIG. 10 together with FIGS. 1 and 2.

In this case, the ECU 122 includes an idle feedback correction value calculation section that calculates an idle feedback correction value for the idle rotational speed of the internal combustion engine 101, and an ISC learning value storage section that stores an ISC learning value calculated based on the idle feedback correction value. The air fuel ratio learning correction value changing section 135 in the ECU 122 stores the amount of update αK of the air fuel ratio learning correction value K at the lean side of the air fuel ratio of the internal combustion engine 101 after changing it in accordance with the ISC learning value.

Specifically, in case where the internal combustion engine 101 is stopped with its temperature having not yet reached the predetermined value after started from a cold state thereof, and where the ISC learning value indicates a predetermined value or less, the air fuel ratio learning correction value changing section 135 stores the amount of update αK of the air fuel ratio learning correction value K at the lean side of the air fuel ratio of the internal combustion engine 101 after setting it to a small value. Here, note that the idle feedback correction value calculation section and the ISC learning value storage section may be included in the function of the various control amount calculation section 138.

Figure 10:
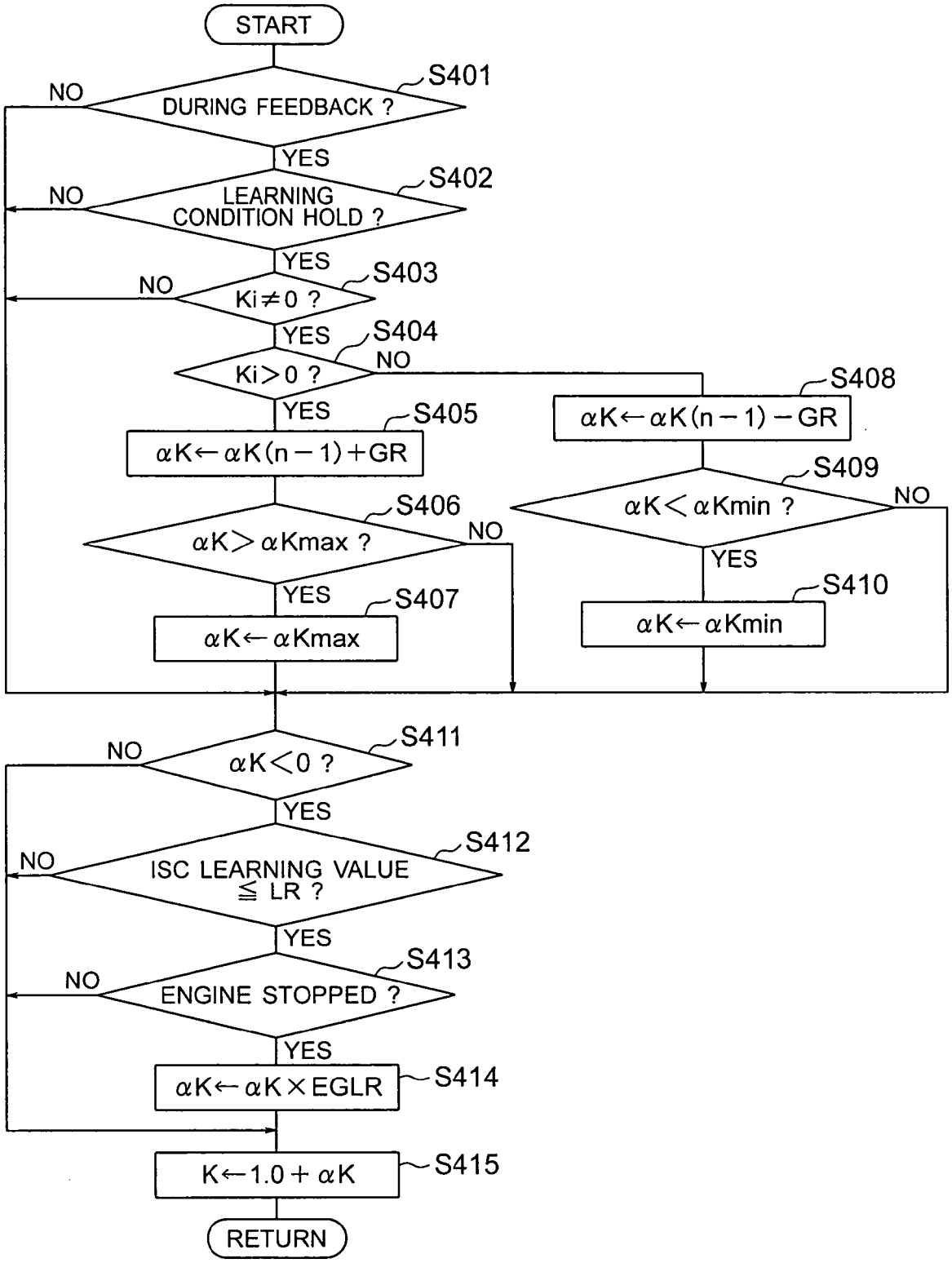
FIG. 10 is a flow chart illustrating a control operation according to a fourth embodiment of the present invention.

FIG. 10 is a flow chart that illustrates a processing operation according to the fourth embodiment of the present invention, in which the calculation processing of the air fuel ratio learning correction value K executed by the ECU 122 in FIG. 1 is specifically shown.

In FIG. 10, steps S401 through S411, S413 and S415 are processes similar to those in the above-mentioned steps S101 through S101, S109, S114 and S116 (see FIG. 4), and step S414 corresponds to the above-mentioned step S115.

The processing routine of FIG. 10 is different from the above-mentioned one (FIG. 4) in that the determination processing of the ISC learning value (step S412) is executed subsequent to step S411 and the amount of update αK is corrected by an update coefficient EGLR in step S414. Also, the processing routine of FIG. 10 is executed at each predetermined time (e.g., 25 msec), similarly as stated above.

In FIG. 10, first of all, steps S401 through S411 similar to the above-mentioned steps S101 through S111 (FIG. 4) are executed. When it is determined in step S411 as αK<0 and hence that the air fuel ratio learning correction value K is corrected to the lean side (that is, YES), it is subsequently determined whether the ISC learning value of the correction value of the ISC valve 121 stored and held after the internal combustion engine 101 is stopped becomes the predetermined value LR (step S412).

When it is determined as the ISC learning value≦LR in step S412 (that is, YES), the control flow proceeds to step S413 where it is determined whether the internal combustion engine 101 is in the stopped state. When it is determined in step S413 that the internal combustion engine 101 is in the stopped state (that is, YES), the amount of update αK of the air fuel ratio learning correction value K is corrected to decrease by using the update coefficient EGLR (step S414), and the control flow proceeds to final step S415.

When either of the results of the determinations in the above steps S411 through S413 is "NO", the decrease correction processing of the update amount αK of the air fuel ratio learning correction value K (step S414) is not executed.

Finally, in step S415, the air fuel ratio learning correction value K is calculated by adding the amount of update αK to the initial value "1.0", and the processing routine of FIG. 10 is terminated.

As described above, according to the fourth embodiment of the present invention, when the ISC learning value is overcorrected to a decrease side due to a secular change or failure of the internal combustion engine 101 and its associated parts, by using the result of a comparison between the ISC learning value and the predetermined value LR as a correction condition of the amount of update αK, the amount of update αK at the lean side of the air fuel ratio learning correction value K is unconditionally corrected to decrease by the update coefficient EGLR after the internal combustion engine 101 is stopped.

Accordingly, the air fuel ratio is enriched in a period until the start of air fuel ratio feedback control after the following cold starting, so it is possible to ensure an output capable of maintaining an appropriate rotational speed of the internal combustion engine 101, thereby making it possible to avoid the reduction of the rotational speed and the engine stall of the internal combustion engine 101.

While the invention has been described in terms of preferred embodiments, those skilled in the art will recognize that the invention can be practiced with modifications within the spirit and scope of the appended claims.

What is claimed is:

1. A control apparatus for an internal combustion engine comprising:

a variety of kinds of sensors that detect an operating condition of said internal combustion engine having a combustion chamber, an intake system and an exhaust system;

an injector that injects fuel into said intake system or said combustion chamber of said internal combustion engine;

an injector driving section that drives said injector in accordance with said engine operating condition;

an air fuel ratio feedback correction value calculation section that calculates an air fuel ratio feedback correction value for said injector driving section;

an air fuel ratio learning section that stores an integrated value of said air fuel ratio feedback correction value after updating said integrated value as an air fuel ratio learning correction value; and an air fuel ratio detecting section that detects an air fuel ratio of an exhaust gas in said exhaust system of said internal combustion engine based on detection signals of said various kinds of sensors;

wherein said air fuel ratio feedback correction value calculation section calculates a target air fuel ratio based on said engine operating condition, and calculates said air fuel ratio feedback correction value so as to bring said air fuel ratio detected by said air fuel ratio detecting section close to said target air fuel ratio;

said air fuel ratio feedback correction value calculation section including:

a temperature detecting section that detects a temperature parameter of said internal combustion engine based on the detection signals of said various kinds of sensors; and an air fuel ratio learning correction value changing section that updates said air fuel ratio learning correction value in accordance with said engine operating condition;

wherein when said internal combustion engine is stopped with said temperature parameter having not yet reached a predetermined value after started from a cold state thereof, said air fuel ratio learning correction value changing section sets an amount of update of said air fuel ratio learning correction value at a lean side of the air fuel ratio of said internal combustion engine in such a manner that the lower said temperature parameter immediately before the starting of said internal combustion engine, the smaller does said amount of update become.

2. The control apparatus for an internal combustion engine as set forth in claim 1, wherein said temperature detecting section detects the temperature of cooling water of said internal combustion engine as said temperature parameter.

3. The control apparatus for an internal combustion engine as set forth in claim 1, wherein said temperature detecting section detects the temperature of lubricating oil of said internal combustion engine as said temperature parameter.

4. A control apparatus for an internal combustion engine comprising:

a variety of kinds of sensors that detect an operating condition of said internal combustion engine having a combustion chamber, an intake system and an exhaust system;

an injector that injects fuel into said intake system or said combustion chamber of said internal combustion engine;

an injector driving section that drives said injector in accordance with said engine operating condition;

an air fuel ratio feedback correction value calculation section that calculates an air fuel ratio feedback correction value for said injector driving section;

an air fuel ratio learning section that stores an integrated value of said air fuel ratio feedback correction value after updating said integrated value as an air fuel ratio learning correction value; and an air fuel ratio detecting section that detects an air fuel ratio of an exhaust gas in said exhaust system of said internal combustion engine based on detection signals of said various kinds of sensors;

wherein said air fuel ratio feedback correction value calculation section calculates a target air fuel ratio based on said engine operating condition, and calculates said air fuel ratio feedback correction value so as to bring said air fuel ratio detected by said air fuel ratio detecting section close to said target air fuel ratio;

said air fuel ratio feedback correction value calculation section including:

a temperature detecting section that detects a temperature parameter of said internal combustion engine based on the detection signals of said various kinds of sensors; and an update coefficient calculation section that calculates an update coefficient used at the time of update of said air fuel ratio learning correction value by said air fuel ratio learning section in accordance with said engine operating condition;

wherein when said temperature parameter has not yet reached a predetermined value after said internal combustion engine is started from a cold state thereof, said update coefficient calculation section calculates said update coefficient of said air fuel ratio learning correction value at a lean side of the air fuel ratio of said internal combustion engine in such a manner that the lower said temperature parameter immediately before the starting of said internal combustion engine, the smaller does said update coefficient become.

5. The control apparatus for an internal combustion engine as set forth in claim 2, wherein said temperature detecting section detects the temperature of cooling water of said internal combustion engine as said temperature parameter.

6. The control apparatus for an internal combustion engine as set forth in claim 4, wherein said temperature detecting section detects the temperature of lubricating oil of said internal combustion engine as said temperature parameter.

7. A control apparatus for an internal combustion engine comprising:

a variety of kinds of sensors that detect an operating condition of said internal combustion engine having a combustion chamber, an intake system and an exhaust system;

an injector that injects fuel into said intake system or said combustion chamber of said internal combustion engine;

an injector driving section that drives said injector in accordance with said engine operating condition;

an air fuel ratio feedback correction value calculation section that calculates an air fuel ratio feedback correction value for said injector driving section;

an air fuel ratio learning section that stores an integrated value of said air fuel ratio feedback correction value after updating said integrated value as an air fuel ratio learning correction value; and an air fuel ratio detecting section that detects an air fuel ratio of an exhaust gas in said exhaust system of said internal combustion engine based on detection signals of said various kinds of sensors;

wherein said air fuel ratio feedback correction value calculation section calculates a target air fuel ratio based on said engine operating condition, and calculates said air fuel ratio feedback correction value so as to bring said air fuel ratio detected by said air fuel ratio detecting section close to said target air fuel ratio;

said air fuel ratio feedback correction value calculation section including:

a temperature detecting section that detects a temperature parameter of said internal combustion engine based on the detection signals of said various kinds of sensors;

a cranking time measurement section that measures a cranking time at starting of said internal combustion engine; and an air fuel ratio learning correction value changing section that stores an amount of update of said air fuel ratio learning correction value at a lean side of the air fuel ratio of said internal combustion engine after changing said amount of update in accordance with said cranking time;

wherein when said internal combustion engine is stopped with said temperature parameter having not yet reached a predetermined value after started from a cold state thereof, and when said cranking time indicates a reference time or more, said air fuel ratio learning correction value changing section stores an amount of update of said air fuel ratio learning correction value at a lean side of the air fuel ratio of said internal combustion engine after setting said amount of update to a small value.

8. The control apparatus for an internal combustion engine as set forth in claim 7, wherein said temperature detecting section detects the temperature of cooling water of said internal combustion engine as said temperature parameter.

9. The control apparatus for an internal combustion engine as set forth in claim 7, wherein said temperature detecting section detects the temperature of lubricating oil of said internal combustion engine as said temperature parameter.

10. A control apparatus for an internal combustion engine comprising:

a variety of kinds of sensors that detect an operating condition of said internal combustion engine having a combustion chamber, an intake system and an exhaust system;

an injector that injects fuel into said intake system or said combustion chamber of said internal combustion engine;

an injector driving section that drives said injector in accordance with said engine operating condition;

an air fuel ratio feedback correction value calculation section that calculates an air fuel ratio feedback correction value for said injector driving section;

an air fuel ratio learning section that stores an integrated value of said air fuel ratio feedback correction value after updating said integrated value as an air fuel ratio learning correction value; and an air fuel ratio detecting section that detects an air fuel ratio of an exhaust gas in said exhaust system of said internal combustion engine based on detection signals of said various kinds of sensors;

wherein said air fuel ratio feedback correction value calculation section calculates a target air fuel ratio based on said engine operating condition, and calculates said air fuel ratio feedback correction value so as to bring said air fuel ratio detected by said air fuel ratio detecting section close to said target air fuel ratio;

said air fuel ratio feedback correction value calculation section including:

a temperature detecting section that detects a temperature parameter of said internal combustion engine based on the detection signals of said various kinds of sensors;

an idle feedback correction value calculation section that calculates an idle feedback correction value for an idle rotational speed of said internal combustion engine;

an idle rotational speed learning correction value storage section that stores an idle rotational speed learning correction value calculated based on said idle feedback correction value; and an air fuel ratio learning correction value changing section that stores an amount of update of said air fuel ratio learning correction value at a lean side of the air fuel ratio of said internal combustion engine after changing said amount of update in accordance with said idle rotational speed learning correction value;

wherein when said internal combustion engine is stopped with said temperature parameter having not yet reached a predetermined value after started from a cold state thereof, and when said idle rotational speed learning correction value indicates a predetermined value or less, said air fuel ratio learning correction value changing section stores an amount of update of said air fuel ratio learning correction value at a lean side of the air fuel ratio of said internal combustion engine after setting said amount of update to a small value.

11. The control apparatus for an internal combustion engine as set forth in claim 10, wherein said temperature detecting section detects the temperature of cooling water of said internal combustion engine as said temperature parameter.

12. The control apparatus for an internal combustion engine as set forth in claim 10, wherein said temperature detecting section detects the temperature of lubricating oil of said internal combustion engine as said temperature parameter.

* * * * *